US008804341B2

(12) United States Patent
Hsiao

(10) Patent No.: US 8,804,341 B2
(45) Date of Patent: Aug. 12, 2014

(54) CONTAINER DATA CENTER

(75) Inventor: Sheng-Chung Hsiao, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 421 days.

(21) Appl. No.: 13/273,242

(22) Filed: Oct. 14, 2011

(65) Prior Publication Data

US 2012/0325722 A1 Dec. 27, 2012

(30) Foreign Application Priority Data

Jun. 24, 2011 (TW) ..... 100122141

(51) Int. Cl.
*B65D 81/02* (2006.01)

(52) U.S. Cl.
USPC ..... 361/727; 361/724; 206/591; 312/140; 312/249.1; 312/271

(58) Field of Classification Search
USPC ..... 361/727, 724, 730, 741, 726, 679.02; 206/591, 524.6; 312/140, 140.1, 271, 312/249.1, 351.1, 334.1, 334.27, 334.28
See application file for complete search history.

(56) References Cited

U.S. PATENT DOCUMENTS

| | | | | |
|---|---|---|---|---|
| 5,967,346 | A * | 10/1999 | Price, Jr. | 211/162 |
| 6,678,161 | B1 * | 1/2004 | Claprood et al. | 361/724 |
| 7,475,955 | B2 * | 1/2009 | Dressendorfer et al. | 312/334.26 |
| 2004/0174105 | A1 * | 9/2004 | Hung | 312/351.1 |
| 2009/0198388 | A1 * | 8/2009 | Hillis | 700/300 |
| 2012/0104918 | A1 * | 5/2012 | Peng et al. | 312/334.27 |
| 2012/0104919 | A1 * | 5/2012 | Wu | 312/334.28 |
| 2012/0104920 | A1 * | 5/2012 | Peng et al. | 312/334.28 |
| 2012/0305443 | A1 * | 12/2012 | Hsiao | 206/591 |
| 2012/0318708 | A1 * | 12/2012 | Hsiao | 206/591 |
| 2012/0319544 | A1 * | 12/2012 | Hsiao | 312/111 |

* cited by examiner

*Primary Examiner* — Robert J Hoffberg
*Assistant Examiner* — Michael Matey
(74) *Attorney, Agent, or Firm* — Novak Druce Connolly Bove + Quigg LLP

(57) ABSTRACT

A container data center includes a container, and a number of cabinets arranged in the container. A shockproof device is mounted at the bottom of the cabinet. A support apparatus is mounted at the top of the cabinet. A sleeve is fixed on the top of the cabinet. The supporting apparatus includes a connecting member. The connecting member includes a first end fixed to the top of the container, and a second end opposite to the first end slidably received in the sleeve.

7 Claims, 4 Drawing Sheets

CONTAINER DATA CENTER

CROSS-REFERENCE TO RELATED APPLICATIONS

Relevant subject matter is disclosed in three pending U.S. patent applications, all titled "CONTAINER DATA CENTER", with the application Ser. Nos. 13/237,951, 13/244,624, and 13/270,235, respectively, filed on Sep. 21, 2011, Sep. 25, 2011, and Oct. 11, 2011, respectively, which are assigned to the same assignee as this patent application.

BACKGROUND

1. Technical Field

The present disclosure relates to a container data center.

2. Description of Related Art

A container data center usually includes a container, and many cabinets each holding many servers and received in the container. However, during transportation of the container data center, the servers may be damaged due to vibration or shocks.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
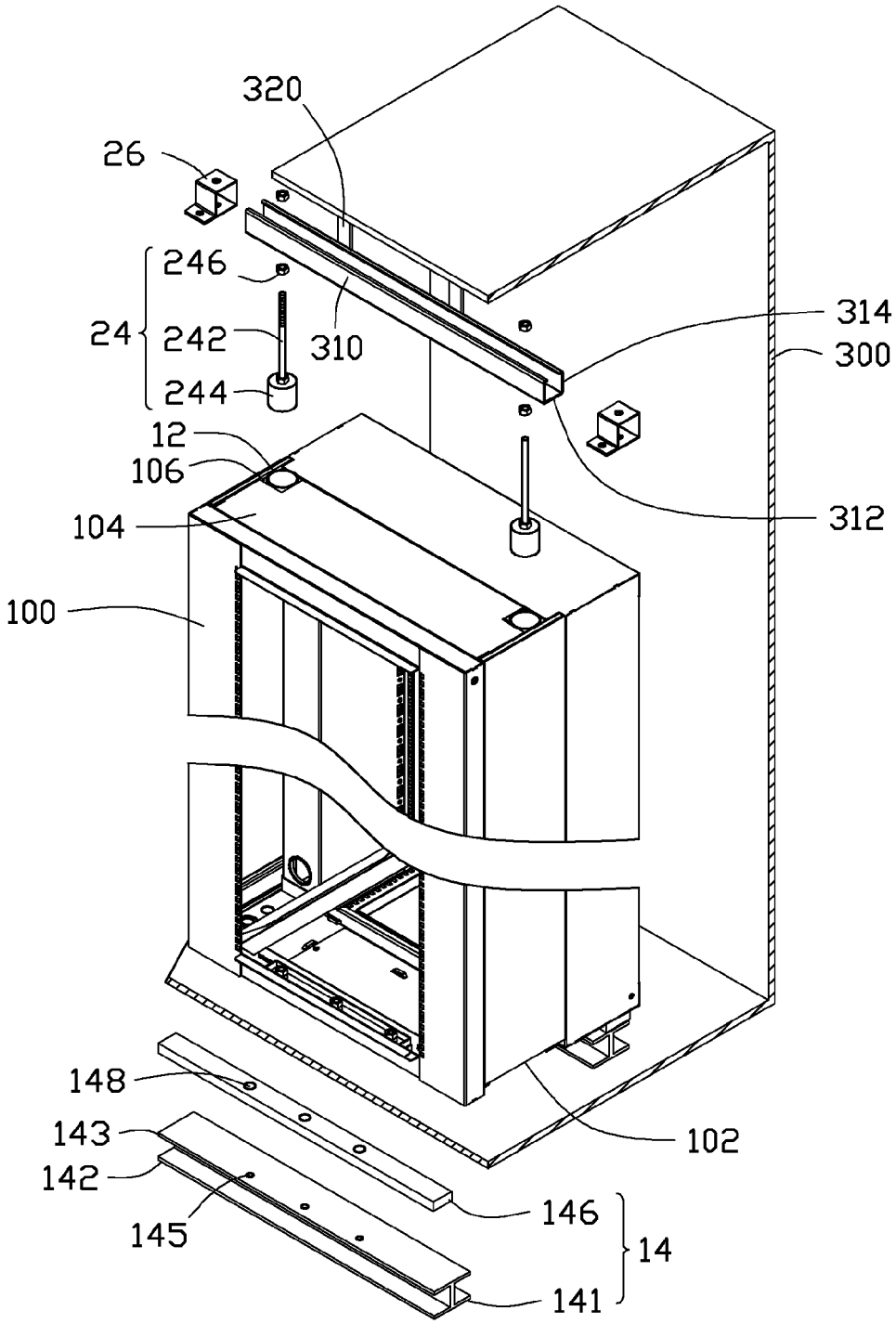
FIG. 1 is an exploded, isometric view of an exemplary embodiment of a container data center, wherein the container data center includes a number of supporting apparatuses.
Figure 2:
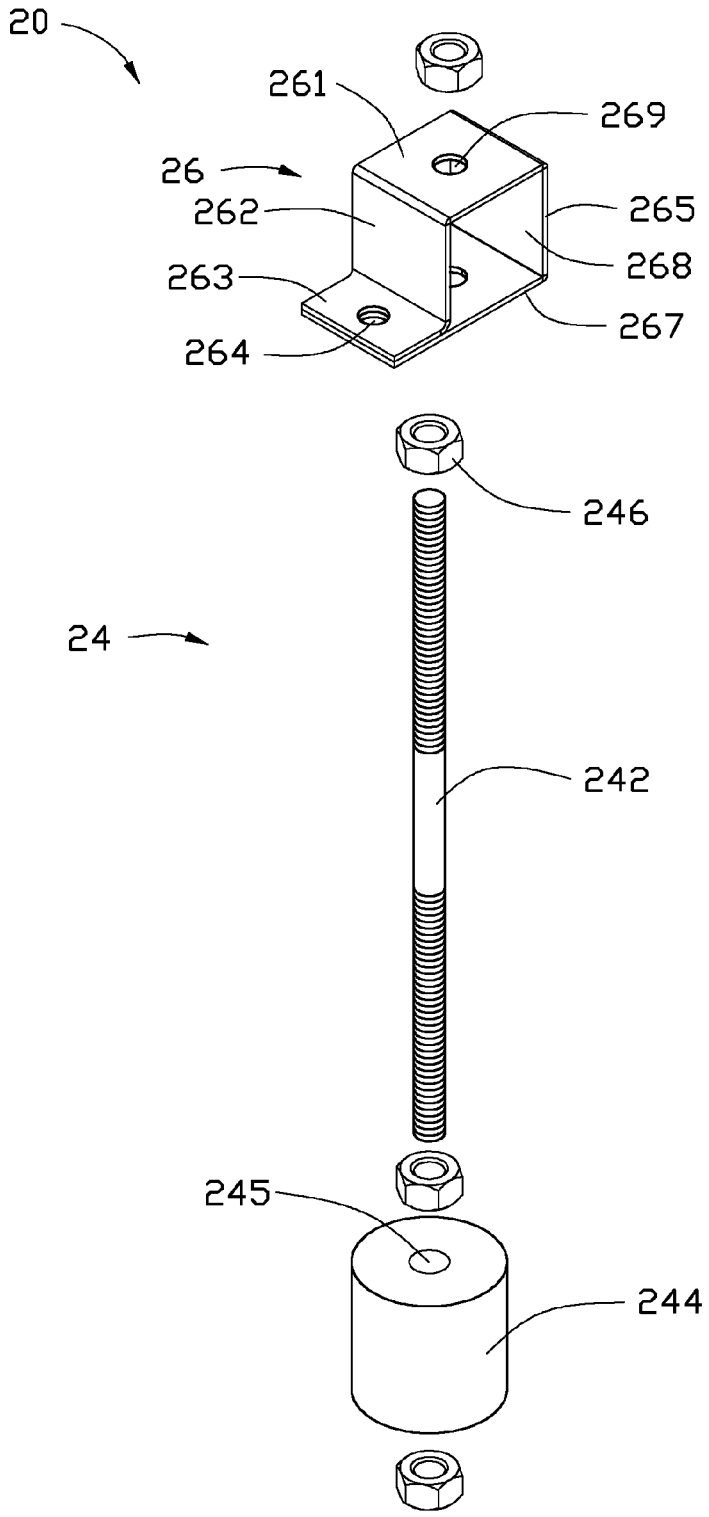
FIG. 2 is an enlarged view of one of the supporting apparatuses of FIG. 1.

Referring to FIG. 1 and FIG. 2, an exemplary embodiment of a container data center includes a container 300, and a number of cabinets 100 arranged in the container 300. Each cabinet 100 includes a bottom wall 102 and a top wall 104 opposite to the bottom wall 102. A pair of shockproof devices 14 is mounted to the underside of the bottom wall 102, and a pair of supporting apparatuses 20 is mounted to the top of the top wall 104. The bottom wall 102 of each cabinet 100 defines a plurality of through holes. The top wall 104 of each cabinet 100 defines an installing hole 106 at each side of the top wall 104, and substantially in the middle. A cylindrical sleeve 12 is inserted in each of the installing holes 106. One or more servers may be installed in each cabinet 100.

The container 300 includes a plurality of fixing brackets 310 which are substantially U-shaped in section, and two hanging or suspension straps (fixing pieces 320) are attached to the inner surface of the top wall of the container 300 and fixedly support each of the fixing brackets 310. The fixing bracket 310 includes a bottom plate 312 and two opposite side plates 314 extending up from the two opposite sides of the bottom plate 312. The bottom plate 312 defines two connecting holes 302 (shown in FIG. 4), at opposite ends of the bottom plate 312.

Each shockproof device 14 includes a support 141, H-shaped in section, and a shockproof member 146.

The support 141 is made up of a long bottom plate 142, a long top plate 143 parallel to the bottom plate 142, and a connecting plate perpendicularly connected between the centers of the bottom plate 142 and the top plate 143. The top plate 143 defines three fixing holes 145, at one side of the connecting plate.

The shockproof member 146 is made of shockproof material, such as plastic or rubber. The shockproof member 146 is a bar of material, and substantially equal in length to the top plate 143. The first shockproof member 146 defines three through holes 148.

Each supporting apparatus 20 includes a connecting member 24, and a fixing member 26.

The connecting member 24 includes a connecting pole 242, a guiding block 244, and a plurality of nuts 246. The guiding block 244 is substantially cylindrical, and axially defines a through hole 245. The connecting pole 242 is threaded at both ends. In the embodiment, the guiding block 244 is made of shockproof material, such as plastic or rubber.

The fixing member 26 is a substantially rectangular frame, and includes a rectangular top plate 261, a first side plate 262 perpendicularly extending down from a front side of the top plate 261, a tab 263 perpendicularly extending forward from the distal end of the first side plate 262, a second side plate 265 perpendicularly extending down from the rear side of the top plate, and a bottom plate 267 perpendicularly extending forward from the distal end of the second side plate 265. The distal end of the bottom plate 267 overlaps with the tab 263, and a single through hole (through hole 264) is defined in the overlap. The top plate 261, the first side plate 262, the second side plate 265, and the bottom plate 267 form a rectangular receiving slot 268. The top and bottom plates 261 and 267 define two opposing fastening holes 269.

Figure 3:
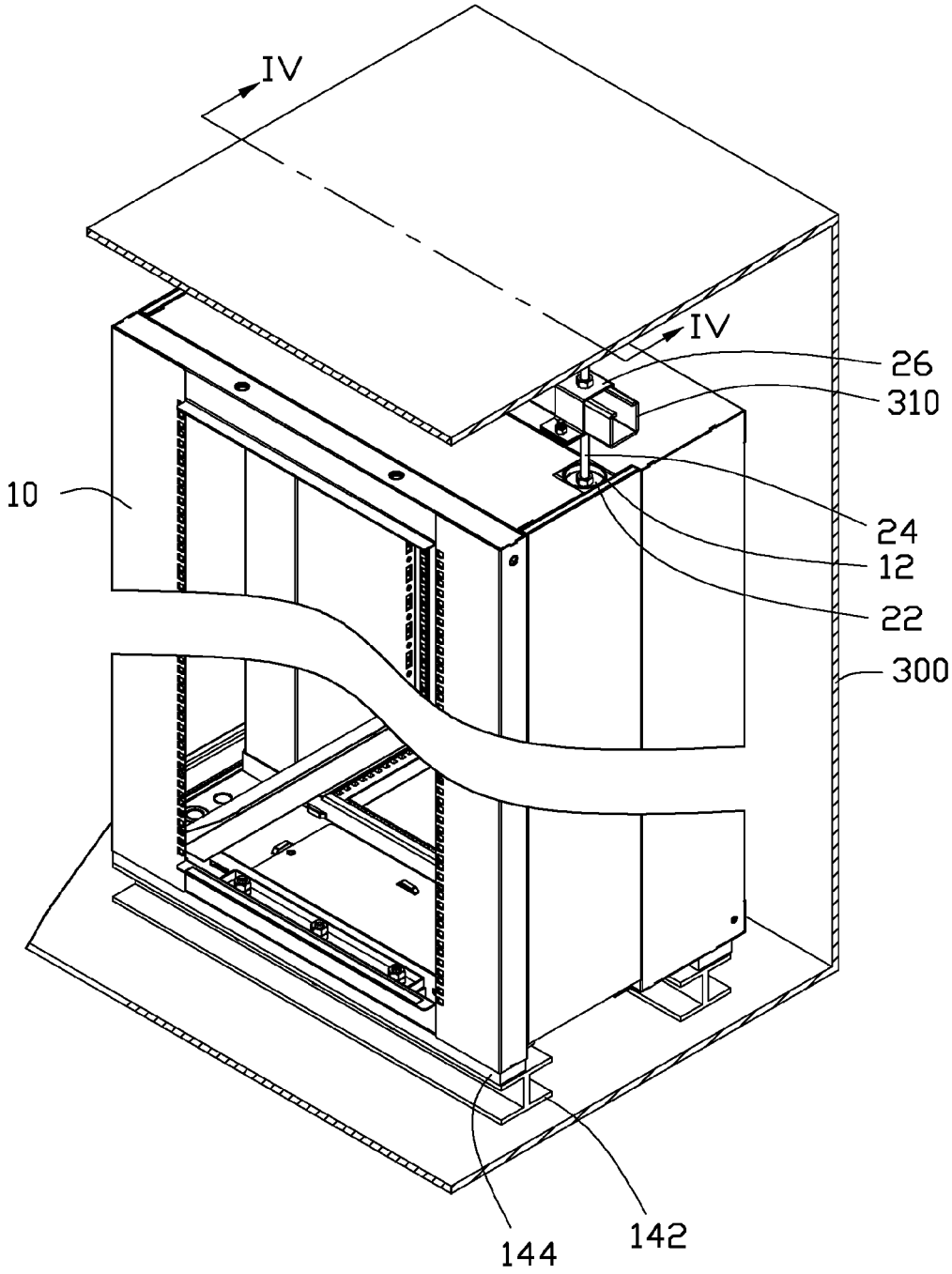
FIG. 3 is an isometric view of the assembled container data center of FIG. 1.
Figure 4:
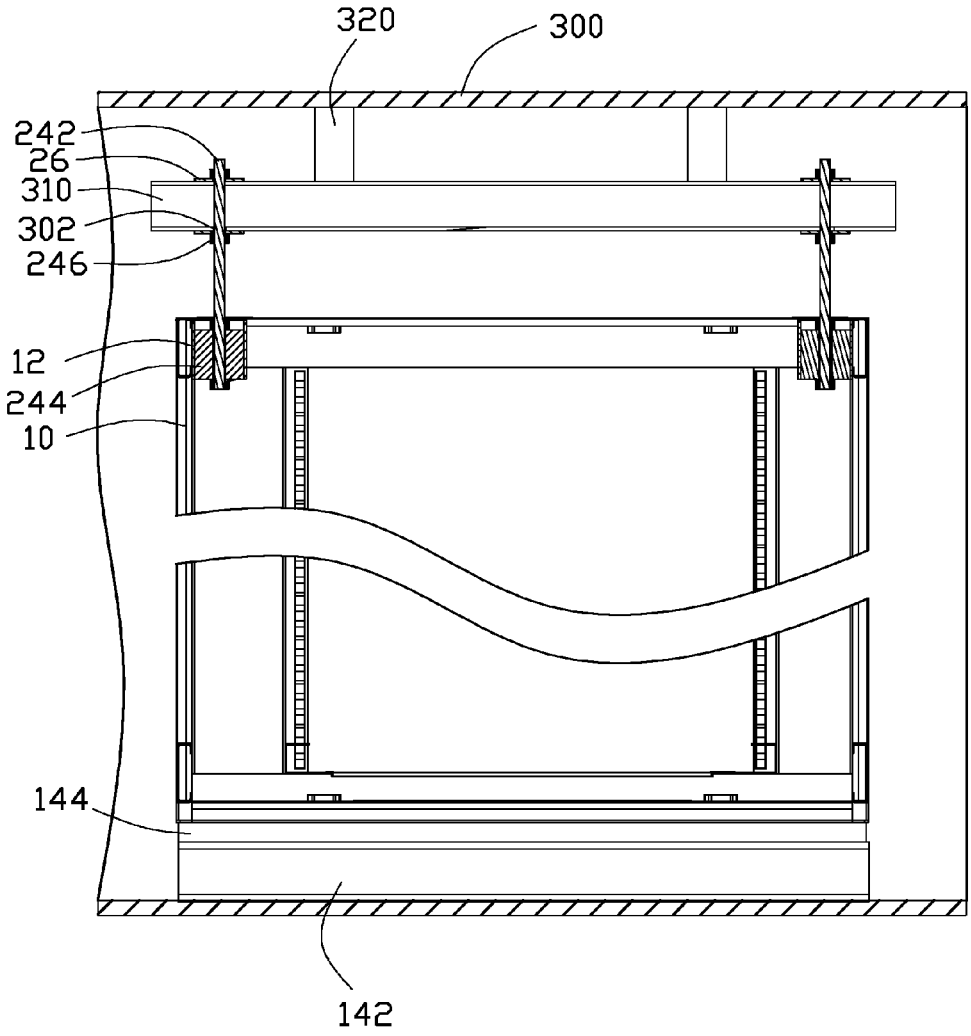
FIG. 4 is a cross-sectional view of the device of FIG. 3, taken along the line IV-IV.

Referring to FIGS. 3-4, in assembly, all the parts of the shockproof devices 14 are mounted to the bottom wall 102, and secured by three screws and nuts through the bottom wall 102.

Each fixing members 26 is fitted about the fixing bracket 310 through the receiving slot 268, to allow the fastening holes 269 to align with the corresponding connecting holes 302 of the fixing bracket 310. A screw extends through the through hole 264 of the tab 263 and the bottom plate 267, into the securing nut. One end of each connecting pole 242 extends through a first nut 246, and the through hole 245, to be screwed into the a second nut 246. The guiding blocks 244 are slidably inserted into the corresponding sleeves 12. Each cabinet 100 is lifted into the bottom of the container 300, to allow the connecting poles 242 to align with the corresponding connecting holes 302. The other end of each connecting pole 242 extends through a third nut 246, the fastening hole 269 of the bottom plate 267, the connecting hole 302, and the fastening hole 269 of the top plate 261, to be screwed into a fourth nut 246. The nuts 246 abutting the fixing member 26 may be rotated, to extend the connecting pole 242 to allow the guiding block 244 to be integrally received in the corresponding sleeves 12.

Each cabinet 100 is fixed to the container 300 by means of the bottom plate 142 being screwed or riveted to the bottom of the container 300.

When the container 300 is shaken, the shockproof member 144 and the guiding block 244 effectively insulate each cabinet 100 from vibration and shock.

It is to be understood, however, that even though numerous characteristics and advantages of the embodiments have been set forth in the foregoing description, together with details of the structure and function of the embodiments, the present disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A container data center comprising:

a container;

a cabinet arranged in the container, the cabinet comprising a top wall, a bottom wall, and a sleeve fixed on the top wall of the cabinet; and a supporting apparatus mounted to an inner surface of a top of the container, one end of the supporting apparatus being slidably engaged in the sleeve, and the other end of the supporting apparatus being extendably mounted to the top of the container, wherein the supporting apparatus comprises a guiding block made of shockproof material, the guiding block is slidably engaged in the sleeve.

2. The container data center of claim 1, wherein the supporting apparatus further comprises a connecting member, the connecting member comprises a connecting pole and the guiding block, the container comprises a fixing bracket fixed to the inner surface of the top of the container, a first end of the connecting pole is adjustably screwed to the fixing bracket, and a second end of the connecting pole is fixed to the guiding block.

3. The container data center of claim 2, wherein the guiding block axially defines a through hole, the connecting pole is threaded on opposite ends, the first end of the connecting pole extends through a first nut, the through hole of the guiding block, to be screwed into a second nut.

4. The container data center of claim 2, wherein a cross-section of the fixing bracket is substantially U-shaped, and comprises a bottom plate defining a connecting hole, the supporting apparatus further comprises a fixing member fitted about the fixing bracket, the fixing member comprises a top plate defining a first fastening hole, the second end of the connecting pole extends through a first nut, the connecting hole of the fixing bracket, and the first fastening hole of the fixing member, to be screwed into a second nut.

5. The container data center of claim 4, wherein the fixing member further comprises a first side plate extending down from a front side of the top plate, a second side plate extending down from a rear side of the top plate, a bottom plate extending forward from a distal end of the second side plate, the top plate, the first side plate, the second side plate, and the bottom plate cooperatively bound a receiving slot fitting about the fixing bracket, the bottom plate defines a second fastening hole opposite to the first fastening hole through which the second end of the connecting pole extends then to extend through the connecting hole of the fixing bracket.

6. The container data center of claim 5, wherein a tab extends forward from a distal end of the first plate, a distal end of the bottom plate overlaps with the tab, the tab and the distal end of the bottom plate define two opposite fixing holes, a screw extends though the fixing holes, to be screwed into a third nut.

7. The container data center of claim 1, wherein each shockproof device comprises a support, and a shockproof member made of shockproof material and sandwiched between the support and the cabinet, a plurality of screws extend through the bottom wall of the cabinet, the shockproof member, and the support, to be screwed into corresponding nuts.

* * * * *